US005898996A

United States Patent [19]

Buchanan et al.

[11] Patent Number: 5,898,996

[45] Date of Patent: May 4, 1999

[54] METHOD OF FORMING A CYLINDRICAL HEAT EXCHANGER HEADER TANK

[75] Inventors: William James Buchanan, Olcott; Siegfried A. Wasse, Grand Island, both of N.Y.

[73] Assignee: General Motors Corporation, Detroit, Mich.

[21] Appl. No.: 08/927,125

[22] Filed: Sep. 5, 1997

[51] Int. Cl.[6] ..... B23P 15/26

[52] U.S. Cl. ..... 29/890.052; 29/890.08; 72/55; 72/334

[58] Field of Search ..... 29/890.052, 890.053, 29/890.08, 465, 421.1; 72/55, 334

[56] References Cited

U.S. PATENT DOCUMENTS

| | | | |
|---|---|---|---|
| 4,234,041 | 11/1980 | Melnyk | 29/890.052 |
| 4,615,385 | 10/1986 | Saperstein et al. | 165/175 |
| 4,761,982 | 8/1988 | Snyder | 72/58 |
| 5,036,913 | 8/1991 | Murphy | 29/890.052 |
| 5,052,478 | 10/1991 | Nakajima et al. | 165/153 |
| 5,193,613 | 3/1993 | Wallis | 29/890.052 |
| 5,243,842 | 9/1993 | Kobayashi et al. | 29/890.052 |
| 5,246,064 | 9/1993 | Hoshino et al. | 165/146 |
| 5,251,694 | 10/1993 | Chigira | 165/173 |
| 5,259,449 | 11/1993 | Case | 165/173 |
| 5,329,990 | 7/1994 | Chigira | 165/153 |
| 5,329,995 | 7/1994 | Dey et al. | 165/153 |
| 5,445,001 | 8/1995 | Snavely | 72/55 |
| 5,607,012 | 3/1997 | Buchanan et al. | 165/173 |
| 5,737,952 | 4/1998 | Baumann | 72/55 |

FOREIGN PATENT DOCUMENTS

| | | | |
|---|---|---|---|
| 0 138 435 | 4/1985 | European Pat. Off. | F25B 39/04 |
| 1959913 | 6/1970 | Germany | 72/334 |
| 0015549 | 7/1969 | Sweden | 72/334 |

OTHER PUBLICATIONS

SAE Technical Paper Series 890225 entitled "Unique Manufacturing Method—Automotive Air Conditioning Condenser Manifold" Sørensen & Cleeton, Feb. 27–Mar. 3, 1989.

*Primary Examiner*—I. Cuda
*Attorney, Agent, or Firm*—Patrick M. Griffin

[57] ABSTRACT

A method for producing a cylindrical automotive condenser manifold tank (28) provides a regularly spaced series of tube insertion slots (66) located entirely externally to the original outer surface of the blank (34) from which the tank (28) is formed. In addition, the slots (66) are provided by a peripheral bulge (54) that provides a lead in surface and support shelf for the ends (24) of the flat flow tubes (22). The blank (34) is hydroformed between a pair of dies (42, 44) designed to create the desired external surface features, while preserving the round inner surface of the blank (34) without an internal support mandrel.

3 Claims, 8 Drawing Sheets

METHOD OF FORMING A CYLINDRICAL HEAT EXCHANGER HEADER TANK

TECHNICAL FIELD

This invention relates to methods of manufacturing cylindrical heat exchanger header tanks.

BACKGROUND OF THE INVENTION

Automotive heat exchangers, such as air conditioning condensers, fall into three basic configurations or types, tube and fin, serpentine, and parallel flow. All three basic designs are decades old at this point, and each presents unique manufacturing challenges. Parallel flow condensers have a plurality of short flow tubes, running horizontally between long, vertical manifold tanks, with each end of each flow tube joined to a tank in a leak free fashion. Serpentine condensers are unique in not requiring long header or manifold tanks, having only one or two long flow tubes that wend back and forth in a distinctive sinuous pattern from end to end. The obvious drawback is the necessity to create a plurality of U shaped bends in the very long flow tubes. Such integral bends cannot be too sharp, and thereby limit how closely the straight portions of the tubes can be packed and spaced. However, the advantage of not having to assure a plurality of leak free braze joints between multiple flow tube ends and their insertion holes in elongated manifold tanks led to their extensive use, at least before braze technology was improved.

Although tube and fin condensers are generally parallel flow also, in terms of their refrigerant flow pattern, they are generally referred to just as tube and fin condensers, because of the unique, braze free method by which their basic cores are produced. In fact, tube and fin was the first design to be produced in large volumes, because of its relatively low cost manufacturing process. A series of round flow tubes, sometimes straight, and sometimes U shaped, are inserted though holes in planar, flat cooling fins, and expanded out into tight mechanical engagement therewith. Thus, the basic core has the advantage of a braze and weld free conductive connection between the flow tubes and the cooling fins, which is very cost effective. It is still necessary, however, to braze or weld a pair of header or manifold tanks to the ends of the round flow tubes in order to feed the refrigerant into and out of the tubes. The header tanks are generally cylindrical tubes themselves, somewhat larger in diameter than the flow tubes, with a series of concave, cylindrical holes or slots punched inwardly along their length for the insertion of the ends of the core's flow tubes. The concave conical flare of the tube insertion slots acts as a lead in to assist the process of inserting the tube ends, and later provides a capillary action to create a good, leak free braze seam. Because of the distinctive appearance created by the concave flow tube insertion holes, such manifold tanks are often referred to as "piccolo" tubes. One obvious advantage of the one piece, cylindrical manifold is that it naturally creates a superior pressure vessel, easily able to withstand up to ten atmospheres or more of internal pressure. An example of the type of condenser just described, with high internal pressure resistance, may be seen in the co assigned European Patent Application 0 138 435 published Apr. 24, 1985 to Farry et al.

One disadvantage of a cylindrical manifold produced with concave, internally directed tube insertion slots is the inherent impediment created to the later installation of flow separation baffles along the length of the manifold. Such baffles divide up the refrigerant flow among the flow tubes into two or more, back and forth flow paths, somewhat similar to the flow that naturally occurs in a serpentine condenser. This can improve thermal performance in many instances. The difficulty arises from the fact that inwardly directed, concave tube slots locally disturb the smooth cylindrical inner profile of the tank. Therefore, the baffles, which are also round or cylindrical, must be inserted in place before the tube slots are punched in. Several distinctive manifold production methods have been proposed for round flow tubes, in part to ease the baffle insertion process, and also to increase the contact area between tube ends and manifold tank, so as to improve the braze joint. An SAE Technical Paper Series number 890225, entitled "Unique Manufacturing Method—Automotive Air Conditioning Condenser Manifolds" written by Jens S. Sorensen and Merle M. Cleeton, from 1989 provides a good overview of one basic design concept, which is to somehow provide external cylindrical stubs, with a significant length running perpendicular to the tank, rather than short, inwardly flared tube insertion slots. Such external stubs can be produced, at least in theory, without disturbing the cylindrical inner profile of the tank. Another alternative would be to use an internal mandrel to support the inside wall of the tank, with slots punched through the tank wall and into matching cutouts in the mandrel. Tube insertion slots so produced, however, would be inherently flat edged, that is, with little or no tube lead in surface at all, neither internal or external. Therefore, the only two practical alternatives are internal, flared tube slots, or external cylindrical tube insertion stubs. External, cylindrical stubs are expensive and difficult to produce, however. The SAE paper cited details a multi step extruding and machining process to produce the external stubs which is lengthy and results in a good deal of scrap. An alternative cold forming process is hinted at, without any particular details. Regardless of the process used to produce them, external, cylindrical tank stubs are, by definition, useful only with cylindrical flow tubes, and cylindrical flow tubes are clearly not the preferred design direction for future, high performance parallel flow condensers.

Future high performance automotive condenser designs will be driven by two very simple and obvious performance criteria. One is the fact that condensers are not inherently limited in performance by the refrigerant drop across the flow tubes, be they the many flow tubes of a parallel flow (or tube and fin) condenser or the single flow tube of a serpentine condenser. Rather, they are limited in the other direction, by the perpendicular cooling air flow forced across the tubes and fins by the same fan that pulls air through the engine cooling radiator. Such fans are limited in power. Second is the obvious fact that the flatter and thinner the flow tube, the less air pressure drop across the core it will cause. Elementary heat exchanger texts have, for decades, taught that a "flattened" or elliptical tube blocks less air flow than a cylindrical or "round" tube. Of course, the ultimate in "flat" tubes is a tube with a thin, rectangular cross section. The thinner it is, the less forced air flow it blocks. Therefore, high performance automotive condensers, now and in the future, will generally be parallel flow, with tubes as thin as it is possible for the tube manufacturers to successfully produce. That has been the clear design direction of tube manufacturers, especially those that make integral, extruded aluminum tubing, since the late 1960's. That is, thinner and thinner tubing, as allowed by advances in their technology, such as improved extrusion die design, higher pressure presses, and improved aluminum alloys.

There are some unique manufacturing issues with parallel flow condensers using flat tubes, as compared to tube and fin condensers using round tubes. Condensers using flat tubing typically use corrugated cooling fins brazed between the flat surfaces of each parallel pair of tubes, instead of planar, flat fins. This is because it is essentially impossible to practically mechanically expand the inside of a very thin, flat tube. In earlier designs, flat tube parallel flow condensers did not typically use cylindrical, one piece manifold tanks. Instead, they used rectangular, two piece tank designs, three sided trough shaped rear piece closed by a slotted header plate at the front. This is because, with the relatively wide flat tubes in use in the early 1980's, a cylindrical manifold tank of round cross section would have been volumetrically inefficient. It would had to have a diameter at least equal to the width of the tubes, making it far larger in volume than necessary. Now that flat tubes have become narrower as well as thinner, cylindrical, one piece manifold tanks for flat tube condensers are potentially practical. However, one piece round manifold tanks for flat flow tubes face the same problem relative to insertion of flow separators.

The typical design disclosed for a round manifold feeding flow into and out of flat condenser tubes is simply the flat tube equivalent of the punched in cylindrical tube insertion slots described above for round tubes. That is, the slots are still punched inwardly, and flared inwardly, but are basically oblong or rectangular in profile, rather than round. Again, one of the inevitable results of inwardly punching closely spaced slots through the tank walls without supporting the inner profile of the tank wall is that the round inner profile of the tank is severely deformed and disturbed. A well illustrated example of the inevitable disturbance of the round tank profile can be seen in U.S. Pat. No. 4,615,385 issued Oct. 7, 1986, to Saperstein, et al. While this creates a desirable tube lead in surface, it makes the later insertion of round flow separators impossible, at least without cutting a dedicated insertion slot through the back of the tank for the separator. A typical separator insertion slot cut through the back of a tank may be seen in U.S. Pat. No. 5,246,064 issued Sep. 21, 1993, to Hoshino et al. As a consequence, some designs attempt to obtain the pressure resistance benefits of a single piece round tank with a two piece round tank, in which two half cylinders are sandwiched together around the separators. An example may be seen in U.S. Pat. No. 5,329,995 issued Jul. 19, 1994, to Dey et al. While the separator insertion slot is eliminated in two piece designs, two fill length braze seams are added instead. As an alternative to punching the tube slots inwardly and disturbing the tube profile, U.S. Pat. No. 5,052,478 issued Oct. 1, 1991, to Nakajima et al. discloses a method of supporting the inner surface of the tank with a cylindrical arbor as the tube slots are punched out. However, with this method, the lead in surface available in the tube slot to guide the flow tube ends into place is limited in thickness to not much more than the wall thickness of the tank material itself. Interestingly, even with the internal arbor to preserve the tank's round inner profile, the use of flow separator insertion slots cut through the back of the tank is still disclosed. Apparently, just the process of punching slots through the wall of even an arbor supported tank wall creates enough burr on the slot edges to prevent the later ram rod type insertion of round flow separators.

SUMMARY OF THE INVENTION

A method of forming a cylindrical heat exchanger tank in accordance with the present invention is characterized by the features specified in claim 1.

In general, in the method of the invention, a cylindrical tube blank is sealed and internally pressurized between a pair of dies that closely support the entire outer surface of the blank, but for a series of regularly spaced depressions of particular shape. The tube blank is thereby expanded out and into the concave depressions. The die depressions are shaped so as to create a series of regularly spaced, convex peripheral bulges, each surrounding a concave, central groove. Each central groove matches the width and thickness of a flat flow tube end, while each peripheral bulge borders a central groove and reinforces the tank wall locally, in the nature of a corrugation. The inner cylindrical profile of the blank is undisturbed by the forming process.

The formed blank is next supported in a piercing apparatus and each inset, central groove is pierced through completely, leaving an oblong slot the proper size to closely receive the end of a flat flow tube. The surrounding peripheral bulge provides both a tube end lead in surface for the slot that it surrounds, as well as a supporting shelf for the tube end. The bulge is substantially thicker than could be provided just by the thickness of the tank wall itself, so that a more effective lead in and support surface can be provided. Moreover, because the regularly spaced bulges are entirely external to the original round interior profile of the blank, they create no impediment to the later insertion of a round flow separator into the tank interior.

BRIEF DESCRIPTION OF THE DRAWINGS

These and other features of the invention will appear from the following written description, and from the drawings, in which.

DESCRIPTION OF THE PREFERRED EMBODIMENT

Figure 16:
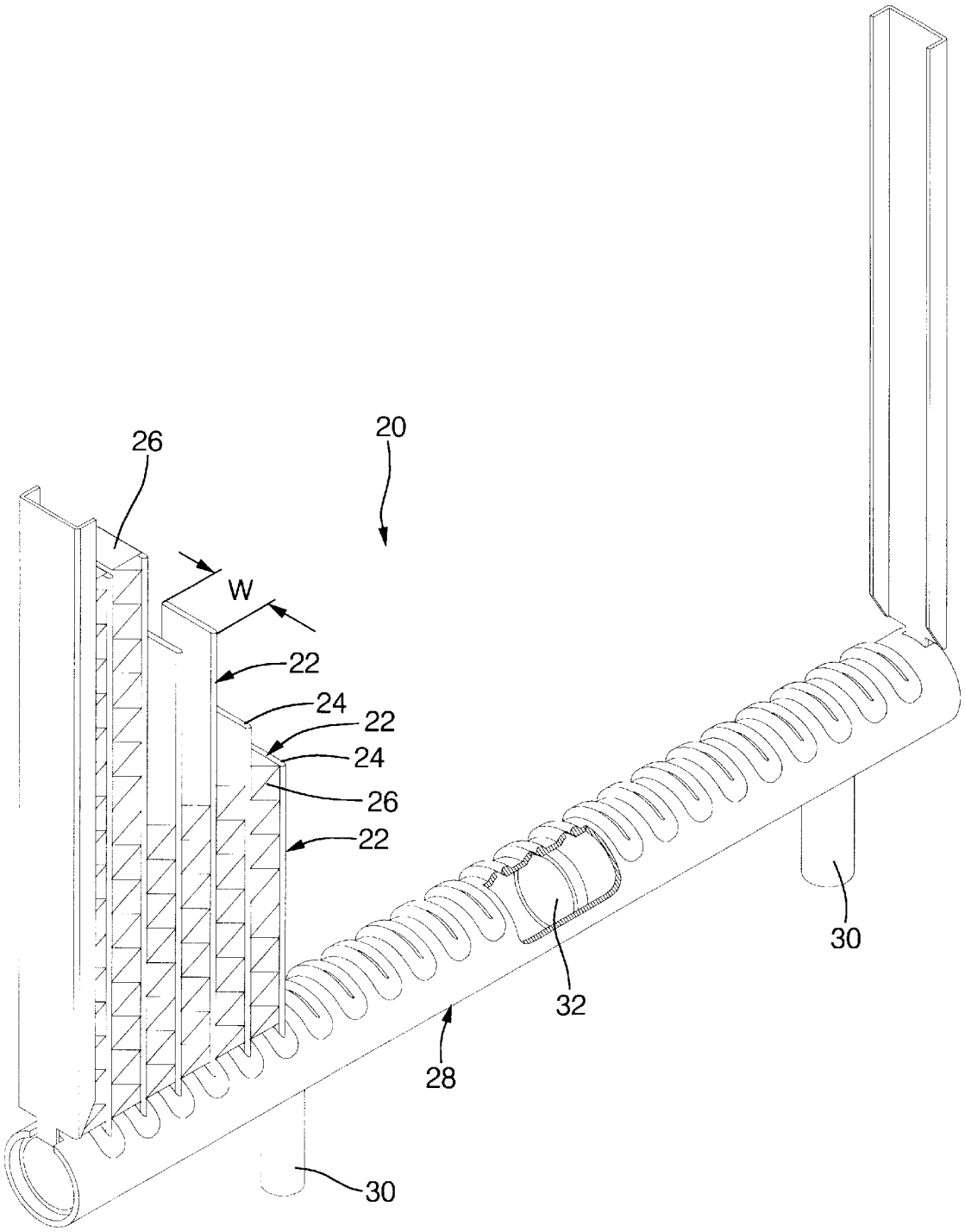
FIG. 16 is a broken away perspective view of a completed condenser and manifold tank.

Referring first to FIG. 16, a completed heat exchanger, which may preferably be an automotive air conditioning system condenser, is indicated generally at 20. Condenser 20 is the parallel flow type described above, with a series of elongated "flat" tubes, each of which is indicated generally at 22. Each tube 22 is preferably an integral, thin aluminum extrusion, though it may be formed of any material and by any method. However formed, each tube 22 has a substantially rectangular, regular cross section all along its length, and is substantially wider (W) than thick (T), including the tube ends 24. These dimensions are a fixed, given quantity, relative to which the method of the invention is designed. A series of corrugated cooling fins 26 is brazed between the regularly spaced tubes 22, forming the basic central core of the condenser 20. Refrigerant is fed into and out of the condenser 20 by a pair of manifold tanks, one of which is indicated generally at 28. The tanks 28 are oriented generally vertically when mounted in a vehicle, in front of the radiator, and the tubes 22 and fins 26 run basically horizontally. While the manifold tanks 28 are basically identical, one tank 28, in the preferred embodiment disclosed, preferably provides both the refrigerant inlet and the outlet, through a pair of fittings 30 divided from one another by an internal round flow separator 32. Refrigerant enters the inlet/outlet tank 28 through one fitting 30, and flows only through those flow tubes 22 located on that side of the separator 32. The flow then enters the other manifold tank 28, not illustrated, which acts as a return tank to send the flow back down the remaining flow tubes 22 located on the other side of the separator 32. Finally, flow exits the remaining fitting 30. This so called two pass flow is now a common one for high performance, parallel flow automotive condensers. The two tanks 28 are produced identically by the method of the invention, but for the later addition of the fittings 30 and separator 32 to whichever tank 28 is designated as the inlet/outlet tank. An added advantage of the method of the invention is that the tank it produces is particularly amenable to the later installation of the separator 32, if needed.

Figure 1:
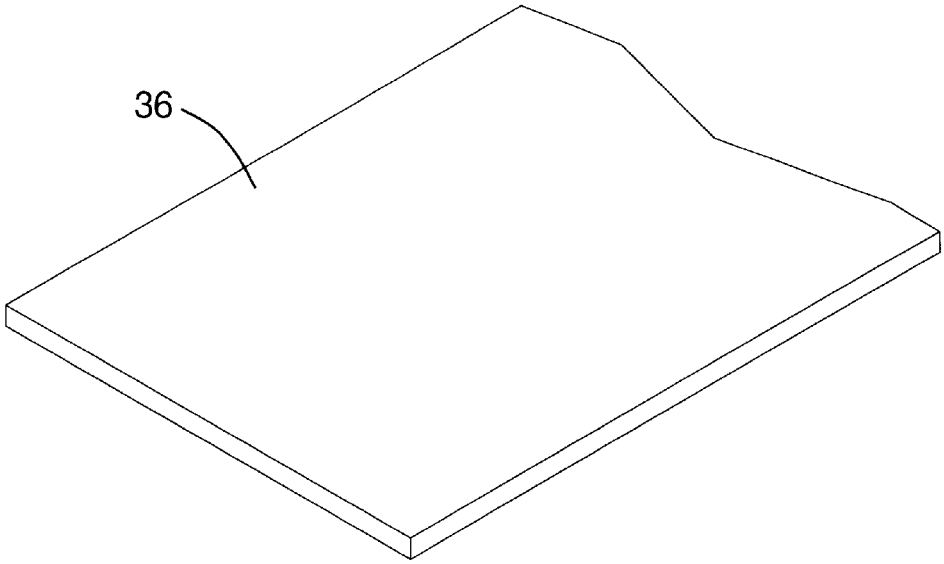
FIG. 1 is a perspective view of a flat sheet used to produce the cylindrical blank.
Figure 2:
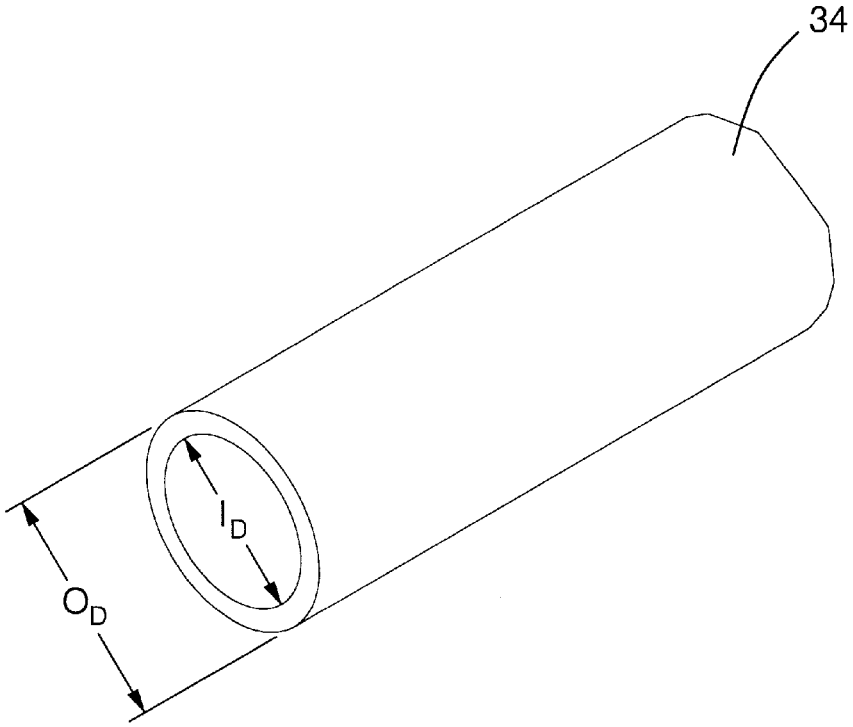
FIG. 2 is a perspective view of an end of the cylindrical blank.

Referring next to FIGS. 1 and 2, tank 28 is produced from a basic tubular or cylindrical one piece blank 34. Blank 34 is preferably first formed from a flat aluminum alloy sheet 36, shown in FIG. 1, which allows it to be easily clad with a braze material on one side. Then, the flat sheet 36 is rolled into a cylinder with the braze layer on the outside, and seam welded down the back to produce the blank 34. Blank 34 could be formed by any other method or material, but braze clad aluminum is especially useful, since it is difficult to braze clad an integral extrusion. Furthermore, since the tubes 22, as noted above, will preferably also be integral extrusions, they will not be braze clad. Therefore, it is especially desirable to have the outer surface of the blank 34 and the tank 28 that it will ultimately form be braze clad, so as to be capable of forming braze seams with the unclad tube ends 24 inserted into tank 28. The most basic requirement of cylindrical blank 34 is that it have an outer diameter (Od) substantially equal to the outer diameter desired for the finished tank 28. If it is also desired that a flow separator 32 be installed, then the inner diameter (Id) of blank 34 should also be substantially equal to the diameter of separator 32.

Referring next to FIGS. 3 through 6, the pressure forming or hydroforming press with which blank 34 is initially molded or formed is indicated generally at 38. Press 38 consists of numerous parts and subsystems, well know to those skilled in the art, only of few of which are described in detail as being most relevant to the particular novel features of the method of the invention. A large outer shell 40 surrounds a pair of inner dies, a first, lower die 42 and a second, upper die, indicated generally at 44. The terms upper and lower are arbitrary, of course, but are used for convenient distinction. The dies 42 and 44 are, in effect, lengthwise split halves of a solid, hollow cylinder, each of which closely supports one side, or approximately one hundred and eighty degrees of, the outer surface of blank 34. Blank 34 is clamped closely between the dies 42 and 44, within the shell 40, while the ends of blank 34 are tightly plugged and its interior highly pressurized by a suitable hydraulic fluid, most often water. Then, the inner surface of blank 34 is expanded and its outer surface is bulged out into the inner surface of the dies 42 and 44, taking on an external shape matching whatever internal shape the dies present to the outer surface of blank 34. This describes the basic pressure forming or hydroforming process, as will be understood by those skilled in the art. The novel features of the method of the invention consist of the details of the internal shape of the dies 42 and 44, especially of upper die 44, and the corresponding shape that they create in the formed blank 34.

Figure 5:
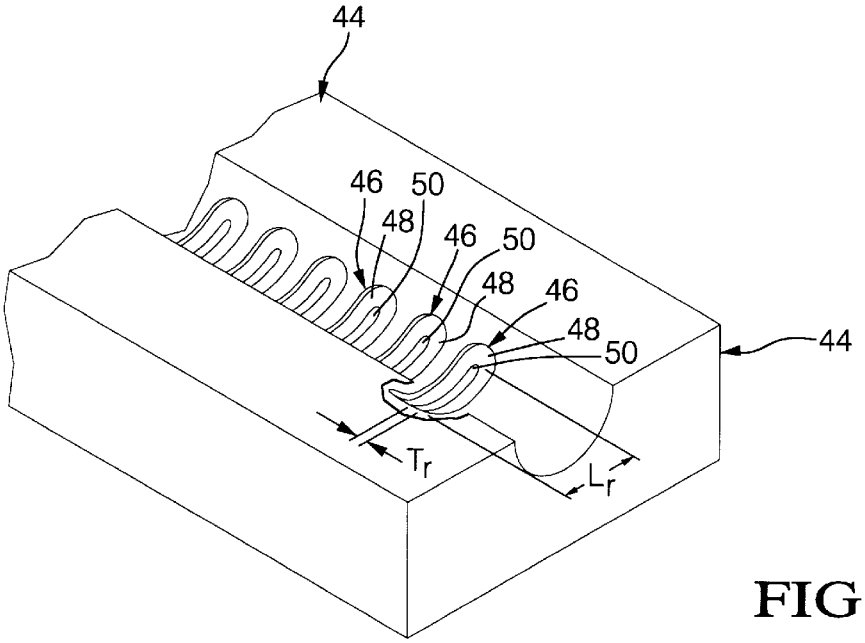
FIG. 5 is a perspective view of the inner surface of one end of the upper dies, illustrating the concave depressions therein.
Figure 6:
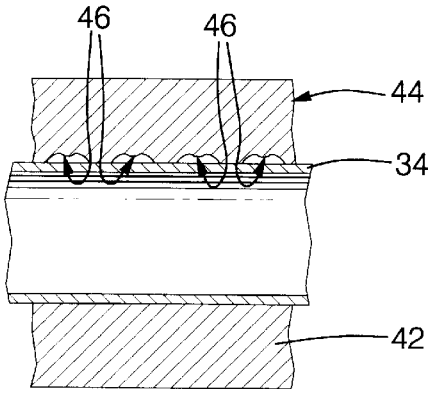
FIG. 6 is a lengthwise cross section of a portion of both dies and a portion of the blank closely supported therebetween, shown prior to forming.

Referring next to FIGS. 5 and 6, details of the shape of dies 42 and 44 are illustrated. Lower die 42 is a smooth half cylinder, the inner surface of which matches the outer diameter of the blank 34. Its function is simply to support one side of the outer surface of blank 34 without significant deformation or shape change. It is the upper die 44 that contains the internal surface features designed to create the desired external surface features of the completed tank 28. The inner surface of upper die 44 is generally smooth and matches that of lower die 42, but for a regularly spaced series of identical depressions formed along its length, indicated generally at 46. Each depressions 46 extends generally perpendicular to the length axis of upper die 44 and is arcuate in shape, subtending approximately one hundred and twenty degrees end to end, although its projection into a plane would be oblong and basically rectangular in shape. Each depression 46 consists of two constituent shapes, a concave, peripheral trough 48 surrounding a central, convex central rib 50. Trough 48 is generally semi cylindrical in cross section with a constant depth that may, if desired, be made deeper than the wall thickness of blank 34 itself. In fact, it can be made as deep as the formability or "stretchability" of the alloy of blank 34 will allow. Preferably, the trough 48 has a constant width across all along its perimeter, as well, though that is not absolutely necessary. Each central rib 50 is convex, at least relative to the surrounding trough 48, thought it sits well inset from the basic cylindrical inner surface of upper die 44. Each rib 50 is also arcuate, with a thickness (Tr) substantially equal to the thickness of a tube end 24 and a flatly projected or chord length (Lr) substantially equal to the width of a tube end 24 This particular shape of each depression 46 is designed to create a tank surface feature described in more detail below.

Figure 3:
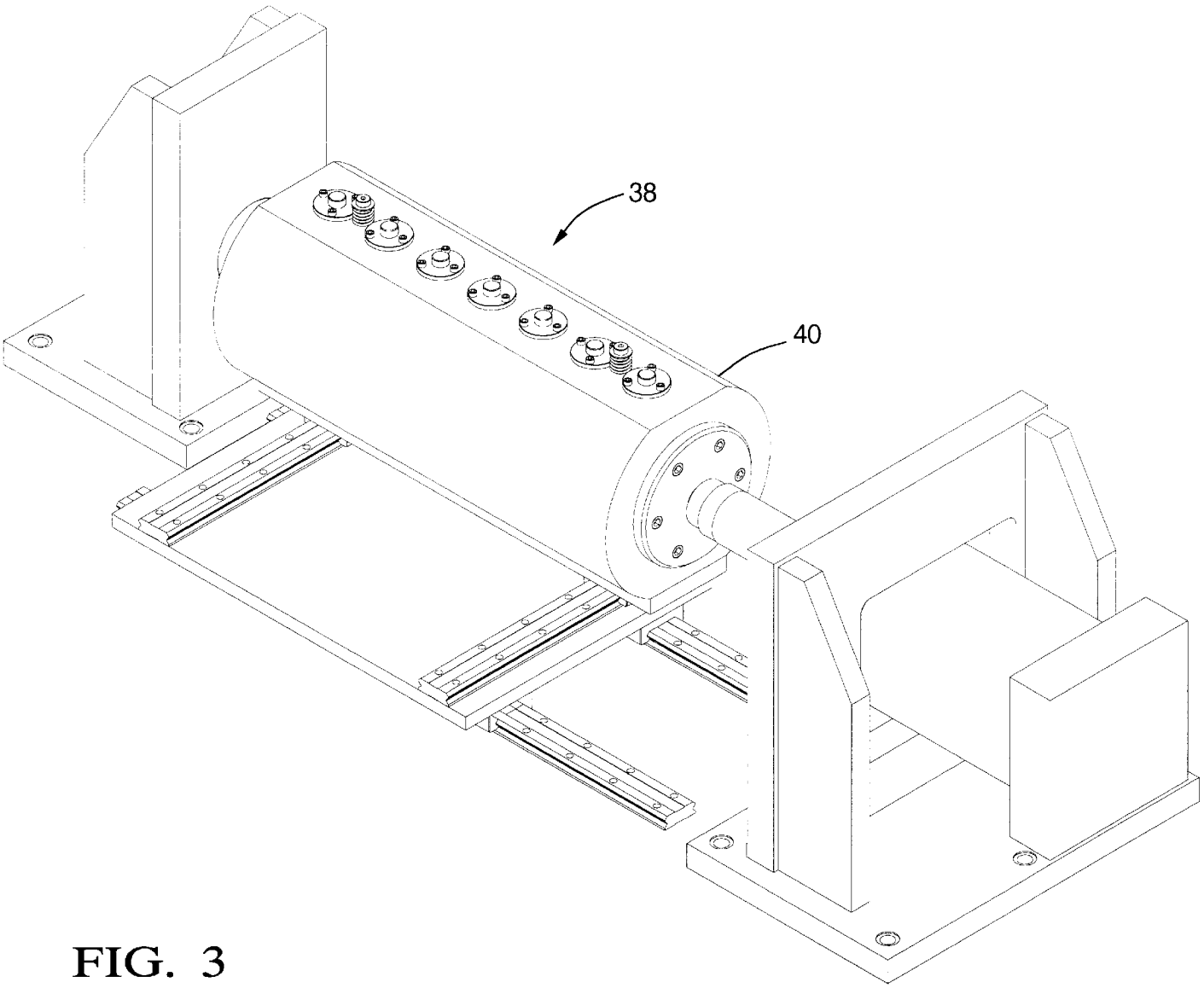
FIG. 3 is a perspective view of the pressure forming apparatus used to mold the blank.
Figure 4:
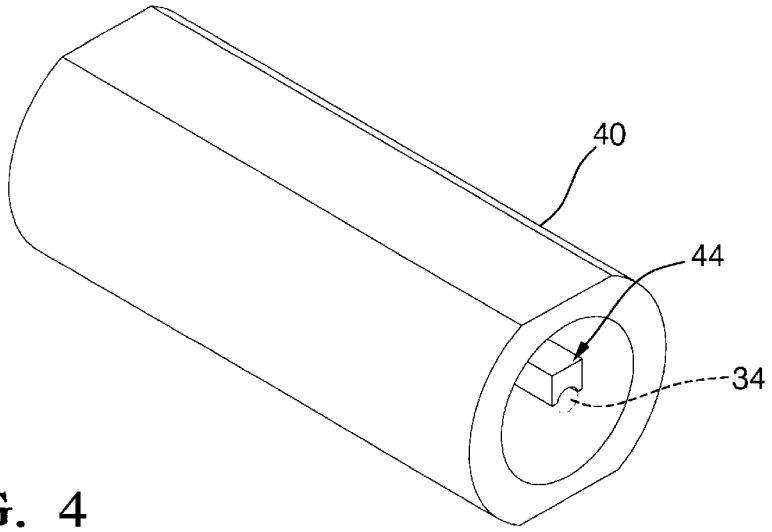
FIG. 4 is a perspective view of just the outer shell of the pressure forming apparatus, showing the location of the upper forming dies and tube blank.

Referring next to FIGS. 3 and 6, the blank 34 is clamped between the dies 42 and 44, which closely support all of the outer surface of blank 34, but for those regions thereof covered by the depressions 46. As best seen in FIG. 6, empty volumes are left external to the outer surface of blank 34 wherever a depression 46 is located. Next, using the press 38 as described above, the interior of blank 34 is highly pressurized, which causes the interior of blank 34 to bulge out wherever unsupported, and causes the exterior of blank 34 to simultaneously closely conform to the inner surfaces of the depressions 46. Inherently, of course, the dies 42 and 44 will support and preserve the inner surface and round profile of the blank 34 everywhere other than at the depressions 46, since the wall of blank 34 is not compressible, even at the high pressures involved. Even where the inner profile of blank 34 is deformed, it will only be enlarged beyond the original inner diameter, never reduced. When the pressure forming between the dies 42 and 44 is complete, the formed blank 34 is depressurized, drained and removed for further processing, described next.

Figure 7:
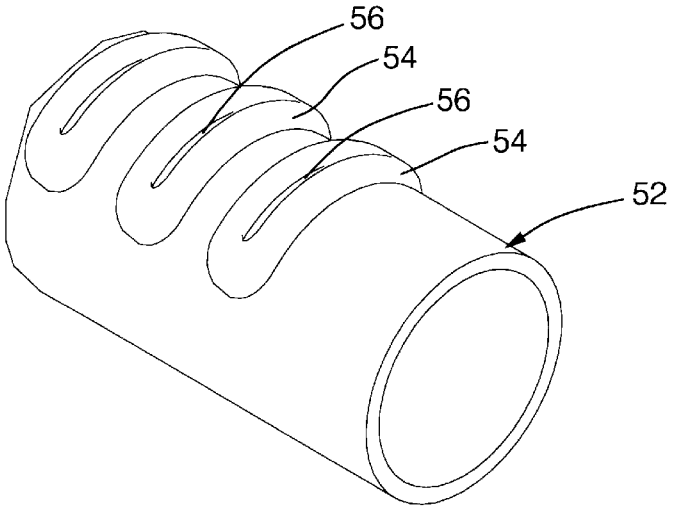
FIG. 7 is a perspective view of the end of the blank after pressure forming, but prior to slot piercing.
Figure 8:
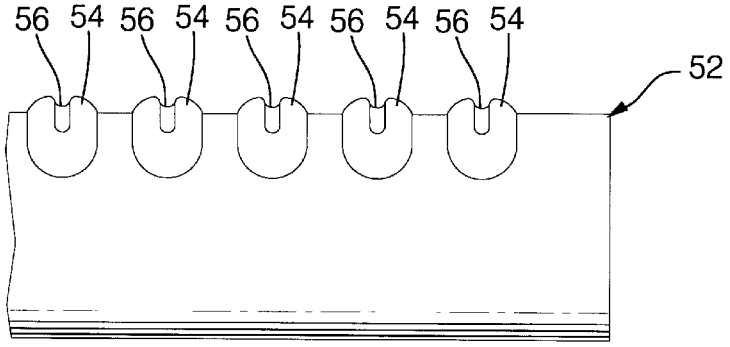
FIG. 8 is a side view of the end of the formed blank of FIG. 7.
Figure 9:
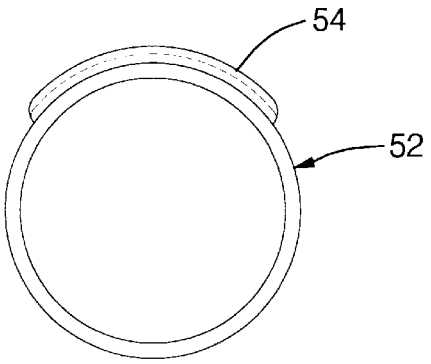
FIG. 9 is an axial end view of the formed blank of FIG. 7.
Figure 10:
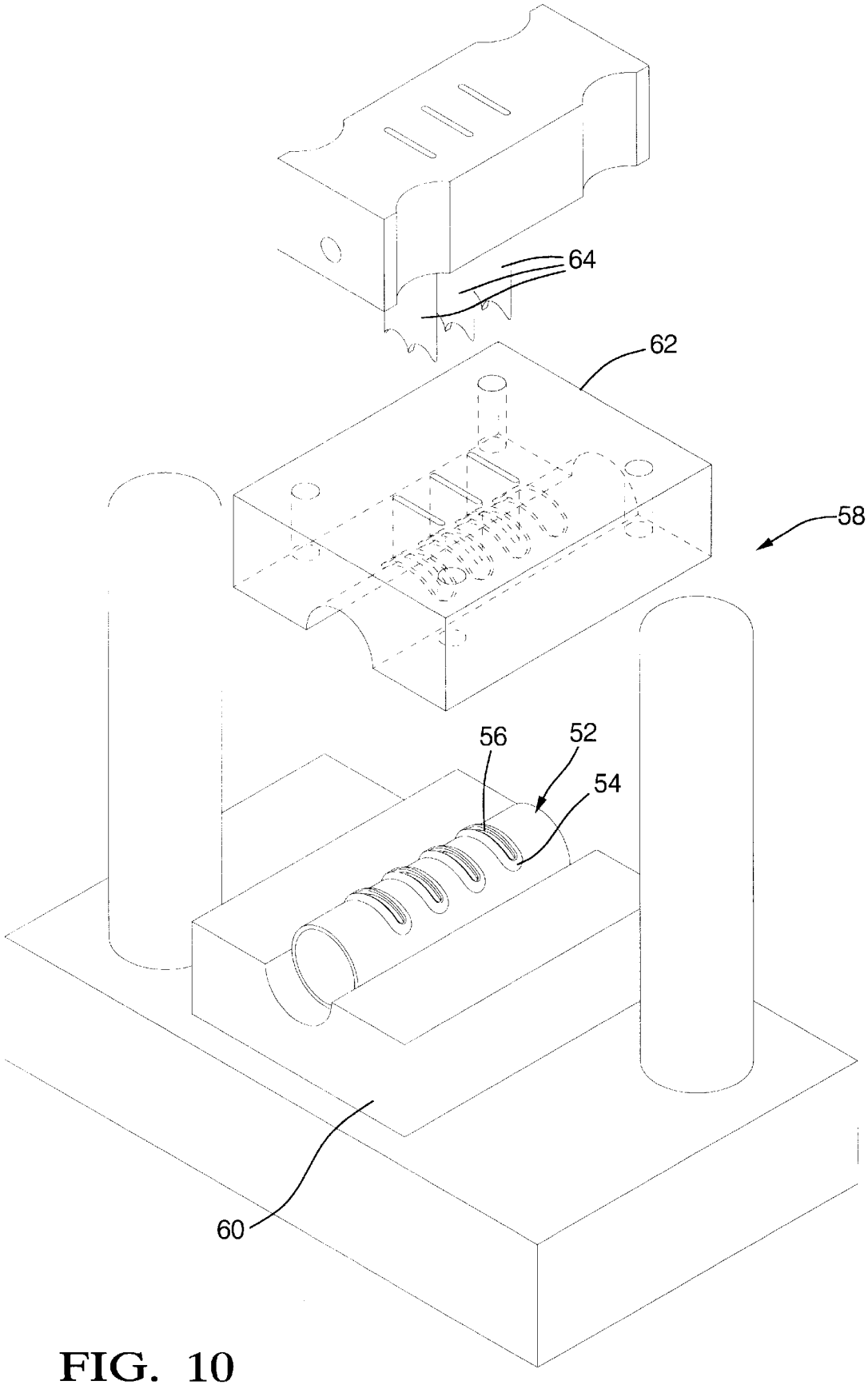
FIG. 10 is a perspective view of the slot piercing apparatus with the formed blank supported therein prior to slot piercing.
Figure 11:
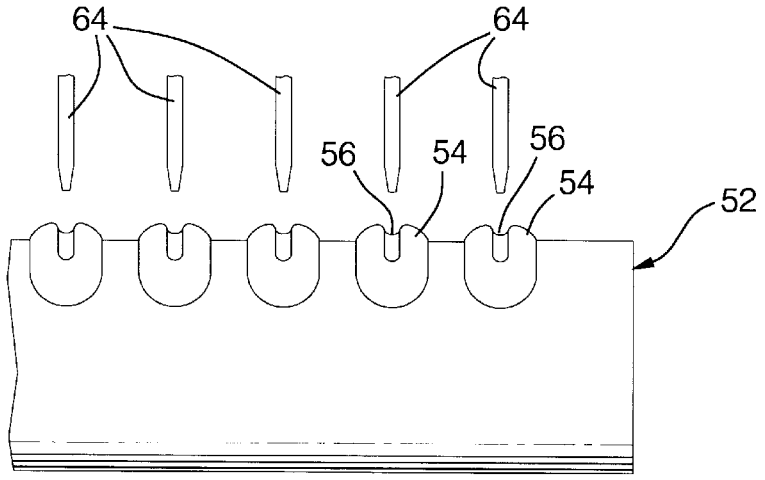
FIG. 11 is a side view of the formed blank with the slot piercing blades approaching the unpierced inset grooves in the formed tube blank.
Figure 12:
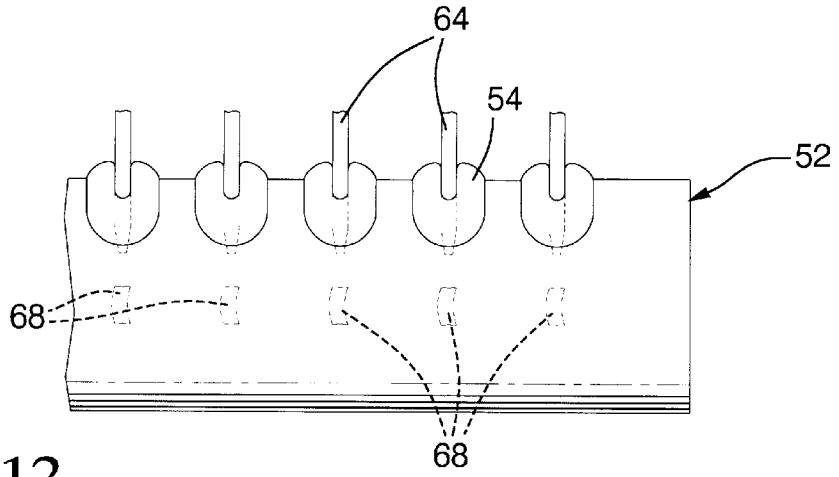
FIG. 12 is the same view as FIG. 11, but showing the piercing blades after having pierced through the inset grooves.
Figure 13:
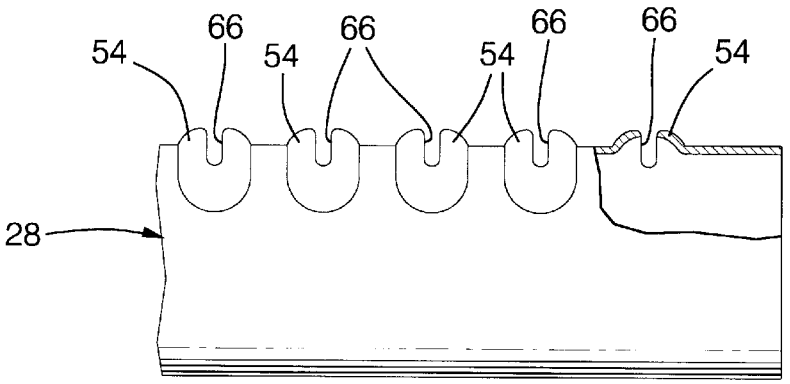
FIG. 13 shows the tube slots fully pierced.
Figure 14:
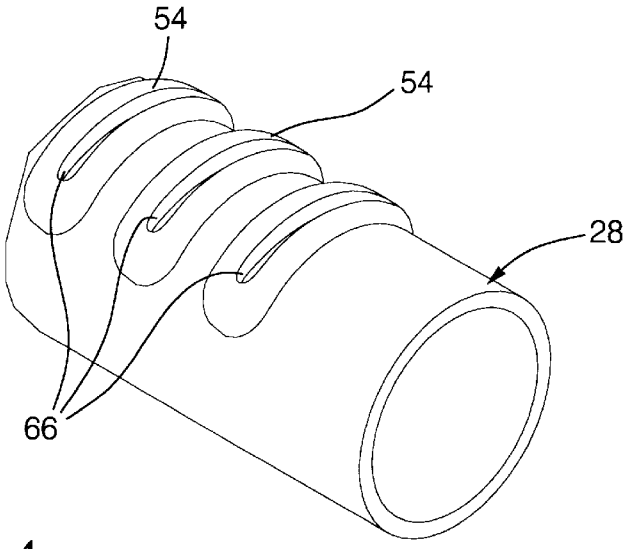
FIG. 14 is a perspective end view of the completed tank.

Referring next to FIGS. 7, 8 and 9, the formed blank, indicated generally at 52, is illustrated. Formed blank 52 is merely an intermediate piece, which needs further processing, but several aspects of it are significant to the shape of the completed tank 28. It will be noted that the round inner and outer profile of the initial blank 34 are everywhere preserved, but for a series of regularly spaced, convex peripheral bulges 54, each of which surrounds an inset central groove 56. Moreover, every part of each bulge 54 and groove 56 is located external to the original outer diameter of the initial blank 34. The shape of the bulges 54 and grooves 56 may be simply described as the converse of the troughs 48 and ribs 50 described in detail above. As can best be seen in FIG. 8, each peripheral bulge 54 is generally semi cylindrical, sloping inwardly toward the inset groove 56. These features are preserved in the completed tank 28.

Referring next to FIGS. 10 through 14, the intermediate formed blank 52 is next transferred to a piercing apparatus indicated generally at 58. A support cradle 60, similar to lower die 42, holds the lower half of formed blank 52 while an upper blade guide 62, similar to upper die 44, closes over the top half. A regularly spaced series of cutting blades 64 each has a width and thickness substantially equal to a groove 56, and therefor substantially equal in width and thickness to a tube end 24. Once the formed blank 52 is clamped between the lower support cradle 60 and upper blade guide 62, the cutting blades 64 are simultaneously driven down through the blade guide 62 and through the aligned grooves 56. A series of regularly spaced tube slots 66 is created, each of which is properly sized to closely receive a tube end 24, thereby completing the basic manifold tank 28. A piece (or two) of chaff 68 is also punched out of each slot 66, but this simply falls inside the formed blank 52 and may be easily shaken out and removed. Piercing apparatus 58 does not have or need any kind of internal mandrel to support the inner surface of formed blank 52, so there is no structure to remove or clean in order to dispose of the chaff 68. Even though there is no internal support mandrel, the cross sectional shape of profile of formed blank 52 is preserved during the slot cutting process, since each peripheral bulge 54 acts as a localized strengthening corrugation around a central groove 56 as it is pierced through. Each peripheral bulge 54 also provides advantages in the completed tank 28, described next.

Figure 15:
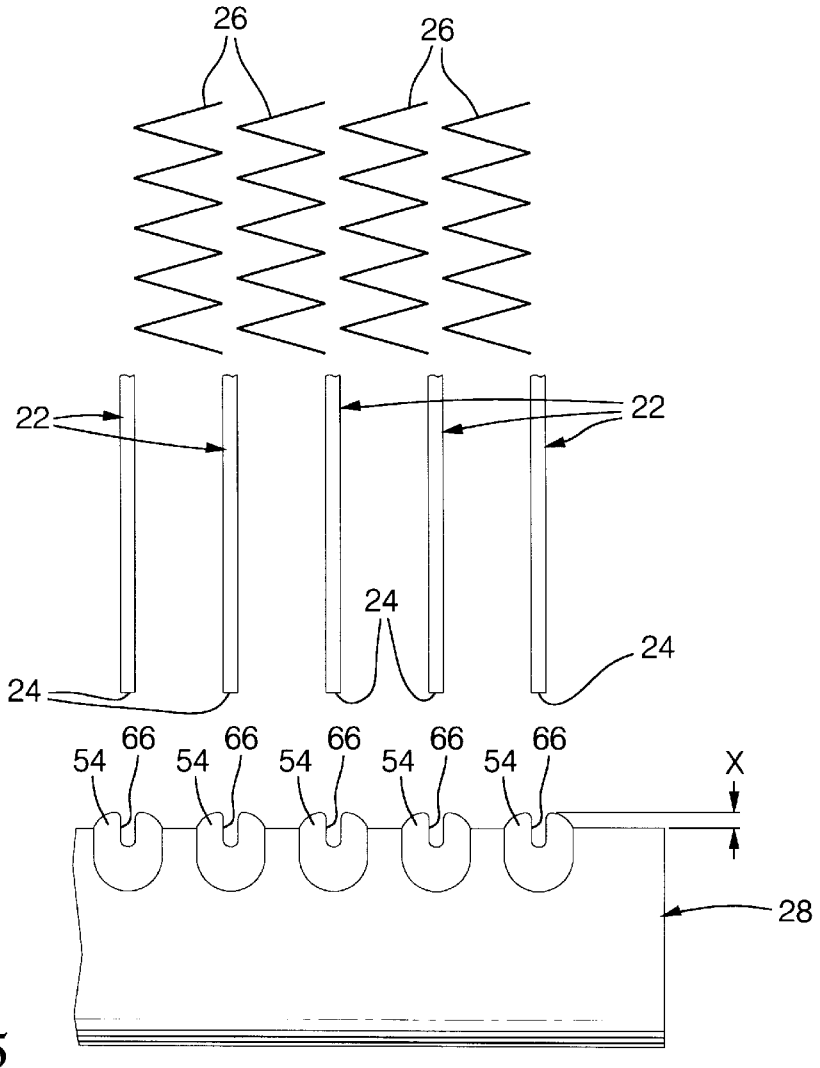
FIG. 15 is a side view of the tank showing the pierced slots aligned with the ends of their respective flow tubes and corrugated cooling fins.

Referring next to FIGS. 15 and 16, the completed tank 28 is ideally suited for the process of assembling the condenser 20. If a round separator 32 is needed, it can be easily installed, as by ramming, to any point along the length of tank 28. There are no deformed areas or slot edge burrs extending inwardly of the original inner diameter of the blank 34 to prevent or interfered with the separator installation process. Even if no separator 32 is needed, the tank 28 is ideally suited for the insertion of the tubes 22 as condenser 20 is assembled. The semi cylindrical cross sectional shape of the peripheral bulges 54 act as lead in surfaces to guide the tube ends 24 toward and into the slots 66 as the tubes 22 are inserted. Since the external peripheral bulges 54 extend radially beyond the original outer diameter of the blank 34 to a degree indicated at X in FIG. 16, they provide a substantial support shelf for the tube ends 24, which need not extend as far into and past the inner diameter of the tank 28 as they otherwise would. And, as noted above, the dimension X is not limited to the wall thickness of the material of tank 28, as it would be if mandrel supported slots had been cut. X is limited only by the depth of the concave troughs 48 in the upper die 44 and, ultimately, limited only by the formability of the alloy from which tank 28 is pressure formed. Moreover, the curved shape of the lead in surface provided by the inner edges of the peripheral bulges 54, where they contact the flat outer surfaces of the tube ends 24, provides an ideal capillary action for the formation of leak free, complete braze seams. Since the tube ends 24 and their supporting surfaces do not intrude so far into the interior of tank 28, a smaller diameter tank 28 may be used, as well. Therefore, the method of the invention presents advantages not only in ease of processing the tank 28, but also in the later assembly and operation of condenser 20 itself.

We claim:

1. A method for producing a cylindrical heat exchanger manifold tank (28) for feeding flow to a plurality of substantially flat flow tubes (22) of predetermined width and thickness, the ends (24) of which flow tubes (22) are inserted into said manifold tank (28) at substantially regularly spaced intervals along the length thereof, comprising the steps of, providing a cylindrical blank (34) with an outer diameter equal to the desired outer diameter of the finished manifold tank (28), providing a first die (42) to create close support for one side of the outer surface of said blank (34), providing a second, matching die (44) to create close support for the remaining side of the outer surface of said blank (34), providing a plurality of regularly spaced, arcuate depressions along the length of the inner surface of said second die (44), said depressions (46) extending substantially perpendicular to the length of said second die (44) and each having a peripheral, concave trough (48) surrounding a convex central rib (50), said rib (50) having a length and width approximately equal to the respective width and thickness of said tubes (22), supporting said blank (34) closely between said dies (42, 44) and internally pressurizing the interior of said blank (34) sufficiently to force the material thereof into conformance with said second die depressions (46), thereby creating a formed blank (52) with a series of regularly spaced, convex external peripheral bulges (54) matching the shape of said concave troughs (48) and surrounding a central concave groove (56) matching the shape of said convex central ribs (50), and, piercing through each central groove (56) in said formed blank (52), thereby creating a finished manifold tank (28) having an undeformed cylindrical inner surface and a regularly spaced series of tube slots (66) properly sized to receive a tube end and each surrounded by a peripheral, external peripheral bulge (54) to provide an external lead in to support and guide the insertion of said tube end (24).

2. The method according to claim 1, further characterized in that a round flow separator (32) is inserted internal to the cylindrical inner surface of said manifold tank (28).

3. The method according to claim 1 further characterized in that the concave trough (48) surrounding said central rib (50) has a substantially constant depth and width and a substantially semi cylindrical cross section.

* * * * *